US008979425B2

(12) United States Patent
Graham et al.

(10) Patent No.: US 8,979,425 B2
(45) Date of Patent: Mar. 17, 2015

(54) SCREED EXTENDER SPEED CONTROL

(71) Applicant: Caterpillar Paving Products Inc., Brooklyn Park, MN (US)

(72) Inventors: Luke E. Graham, Maple Grove, MN (US); Igor S. Ramos, Minnetonka, MN (US); Todd M. Jennings, Ramsey, MN (US); Kea V. Chin, Washington, IL (US); Daniel D. Podany, Peoria, IL (US); LaTanya G. Turner, Magnolia, MN (US); Yasin H. Mohamed, Minneapolis, MN (US); Jameson M. Smieja, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 137 days.

(21) Appl. No.: 13/663,695

(22) Filed: Oct. 30, 2012

(65) Prior Publication Data

US 2014/0119826 A1 May 1, 2014

(51) Int. Cl.

*E01C 19/22* (2006.01)
*E01C 19/42* (2006.01)
*E01C 19/48* (2006.01)

(52) U.S. Cl.

CPC ..... *E01C 19/48* (2013.01); *E01C 19/42* (2013.01)
USPC ..... 404/118

(58) Field of Classification Search

USPC ..... 404/104, 118, 120
See application file for complete search history.

(56) References Cited

U.S. PATENT DOCUMENTS

| | | | | |
|---|---|---|---|---|
| 4,571,500 | A | 2/1986 | Mucheyer | |
| 4,796,712 | A | 1/1989 | Rutkowski et al. | |
| 4,846,283 | A | 7/1989 | Batcheller | |
| 5,362,176 | A * | 11/1994 | Sovik | 404/72 |
| 6,561,076 | B2 | 5/2003 | Hou et al. | |
| 7,182,549 | B2 | 2/2007 | Wiker | |
| 7,401,542 | B2 | 7/2008 | Stephens et al. | |
| 8,641,321 | B2 * | 2/2014 | Eul et al. | 404/118 |
| 2010/0150650 | A1 * | 6/2010 | Buschmann et al. | 404/82 |
| 2010/0186401 | A1 * | 7/2010 | Kauss et al. | 60/327 |
| 2010/0196096 | A1 * | 8/2010 | Halonen et al. | 404/84.1 |
| 2010/0284742 | A1 | 11/2010 | Christ et al. | |
| 2011/0091278 | A1 | 4/2011 | Munz et al. | |
| 2011/0123267 | A1 | 5/2011 | Buschmann et al. | |
| 2013/0142572 | A1 * | 6/2013 | Eul et al. | 404/118 |

FOREIGN PATENT DOCUMENTS

EP 2599920 A1 * 1/2011

* cited by examiner

*Primary Examiner* — Abigail A Risic
(74) *Attorney, Agent, or Firm* — BakerHostetler

(57) ABSTRACT

A control system for an extendable screed includes a first input device configured to set a speed limit for the extendable screed, a second input device configured to vary a speed of the extendable screed within the speed limit. The controller further includes, a third input device configured to govern a relationship between a speed of the extendable screed and a relative position of the second input device. The control system further includes a controller configured to receive inputs from the first, the second, and the third input devices and output a command signal to move the extendable screed relative to the main screed.

20 Claims, 5 Drawing Sheets

SCREED EXTENDER SPEED CONTROL

TECHNICAL FIELD

The present disclosure relates to an extendable screed, and more particularly to an electro-hydraulic control system associated with the extendable screed.

BACKGROUND

Typically, pavers utilize extendable screed assemblies to widen an effective paving width. The screed assembly includes a main screed and an extendable screed movably attached to the main screed. An electro-hydraulic system is provided to extend or retract the extendable screed relative to the main screed. The electro-hydraulic system includes an on/off switch to move and stop the extendable screed at a desired width of paving. However, during operation, a greater control is required to move and vary the width of paving using the extendable screed. There is a need for improved electro-hydraulic control system to vary the speed of the extendable screed during operation.

SUMMARY

In one aspect, the present disclosure provides a screed assembly including a main screed, an extendable screed movably attached to the main screed, and a control system for the extendable screed. The control system includes a first input device, a second input device, a third input device, and a controller. The first input device configured to set a speed limit for the extendable screed, and the second input device configured to vary a speed of the extendable screed within the speed limit. Further, a third input device configured to govern a relationship between a speed of the extendable screed and a relative position of the second input device. Based on the inputs received from the first, the second, and the third input devices the controller outputs a command signal to move the extendable screed relative to the main screed.

In another aspect, the present disclosure provides a method for moving the extendable screed relative to a main screed. The method includes steps of producing a limiting signal and a control signal from the first input device and the second input device, respectively. The limiting signal is indicative of the speed limit for the extendable screed and the control signal varies the speed of the extendable screed within the speed limit. The method further includes a step of selecting a modulation curve by a third input device for varying a relationship between a speed of the extendable screed a relative position of the second input device. The method outputs a command signal using the controller, based on the limiting signal, the control signal, and the modulation curve to move the extendable screed relative to the main screed.

Other features and aspects of this disclosure will be apparent from the following description and the accompanying drawings.

DETAILED DESCRIPTION

Figure 1:
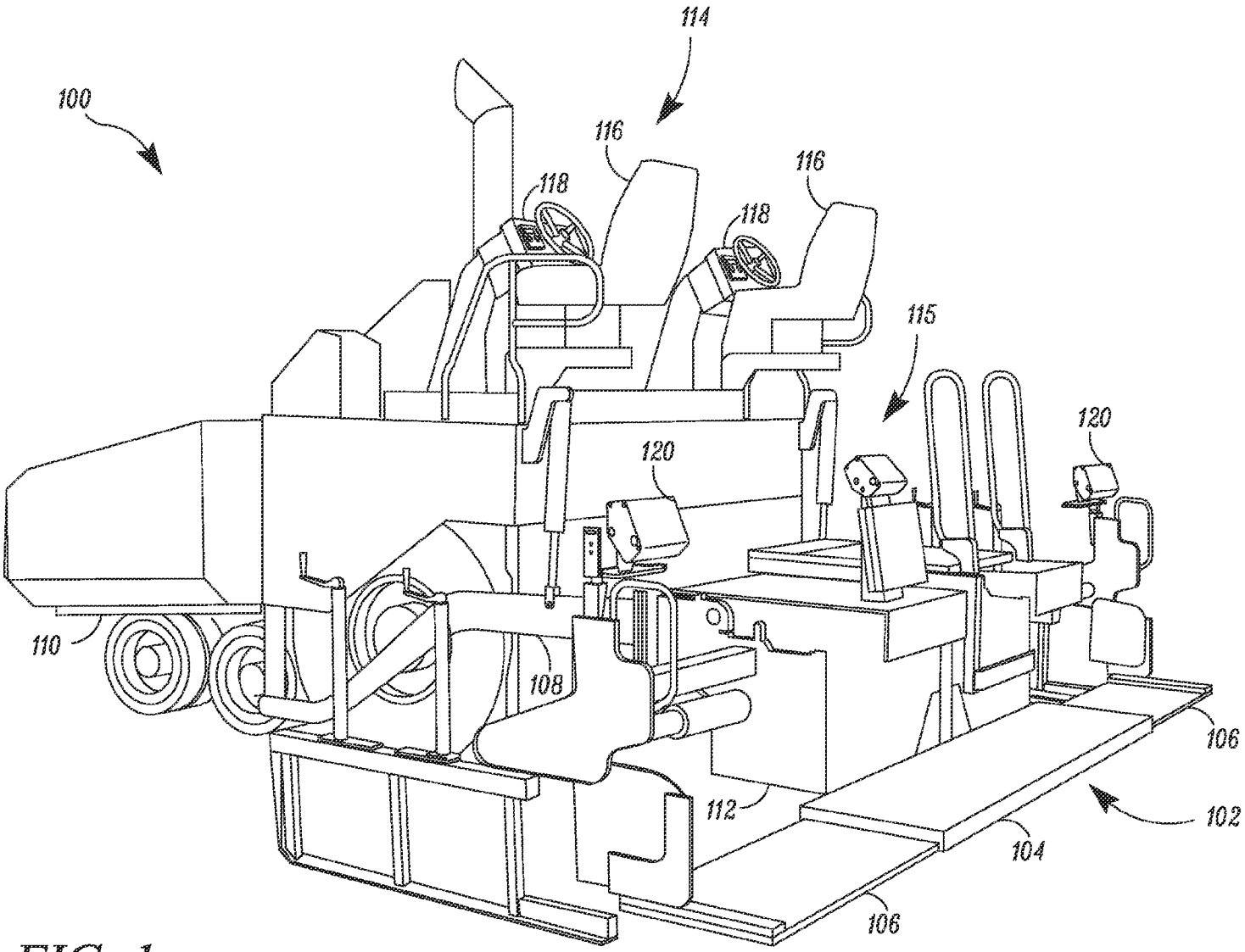
FIG. 1 is a perspective view of a paver having a screed assembly.

The present disclosure describes a system and method for speed control of an extendable screed, according to an aspect of the present disclosure. FIG. 1 illustrates a side view of a paver 100, according to an embodiment of the present disclosure. The paver 100 may be a crawler track type or rubber tire type. The paver 100 includes a screed assembly 102 having a main screed 104 and an extendable screed 106. The main screed 104 may be connected to an end of a tow arm 108. The other end of the tow arm 108 may be pivotally connected to the chassis 110 of the paver 100 in a manner for towing the screed assembly 102. The extendable screed 106 is movably attached to the main screed 104. In an embodiment, the main screed 104 may include a screed extension carriage 112, for mounting the extendable screed 106. The extendable screed 106 may be mounted rearwardly of the main screed 104. However, the extendable screed 106 may be mounted in front of the main screed 104.

Moreover, the main screed 104 may also include a mechanism to control pavement slope and/or crown of a screed plate carried by the main screed 104. In an embodiment, the main screed 104 may include two sections, one on each side of a center line of the paver 100. Accordingly, the extendable screed 106 may be symmetrically mounted to the each section of the main screed 104. It will be apparent to a person skilled in the art that the screed assembly 102 is symmetrical with respect to the center line of the paver 100, and the present disclosure will be described with reference to only one section of the main screed 104 and the associated extendable screed 106.

The paver 100 may include a paver operator station 114, and a screed operator station 115. The paver operator station 114 is used for controlling various functions in the paver 100 and also few functions associated with the screed assembly 102, while the screed operator station 115 primarily used to control the screed assembly 102 The paver operator station 114 may include seats 116 for operators. Further, the paver operator station 114 and the screed operator station 115 may include respective user interfaces 118, 120. The user interfaces 118 and 120 may be used for accepting various inputs from the operator and also displaying information to the operator.

Figure 2:
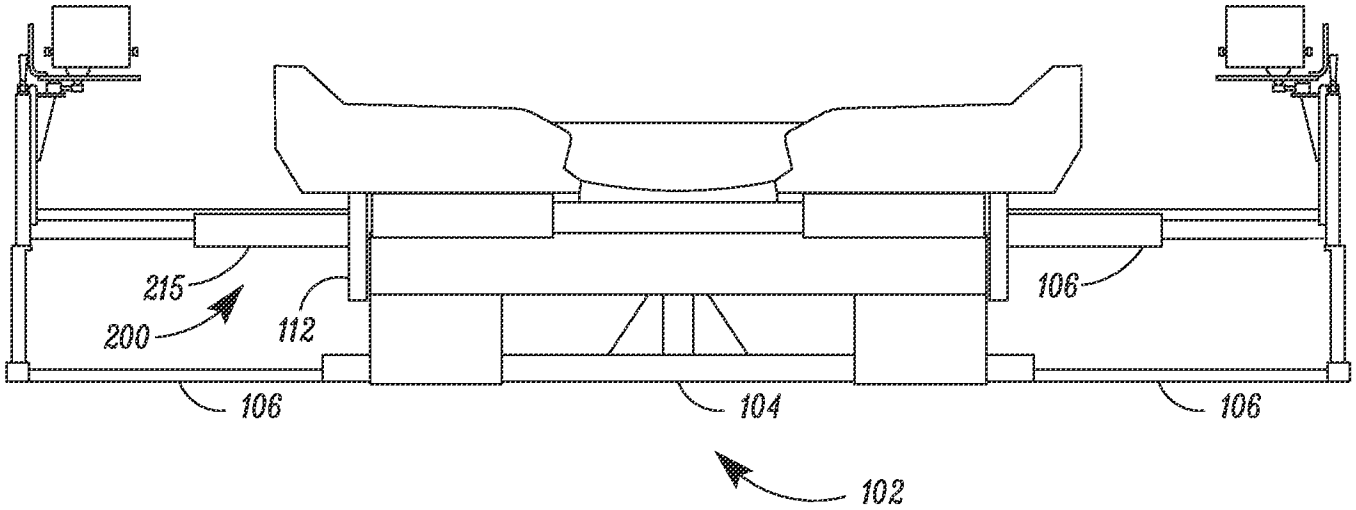
FIG. 2 is a rear view of the screed assembly of FIG. 1.

A rear view of the screed assembly 102 is illustrated in FIG. 2. In an embodiment, a hydraulic system 200 is provided for extending and retracting the extendable screed 106 relative to the main screed 104. The hydraulic means 200 includes a hydraulic cylinder 215 for extending and retracting the extendable screed 106 relative to the main screed 104.

Figure 3:
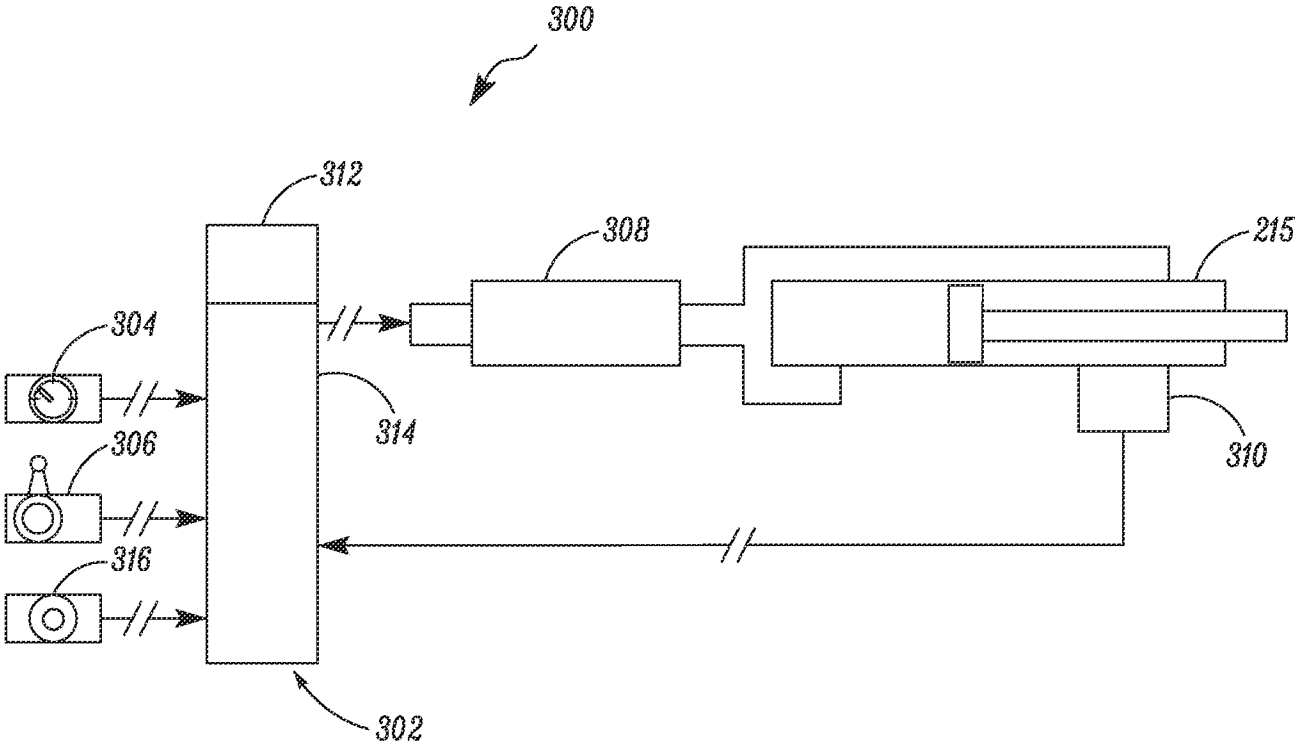
FIG. 3 is a block diagram of a control system for the screed assembly of FIG. 1.

FIG. 3 illustrates a block diagram of a control system 300 for the extendable screed 106, according to an embodiment of the present disclosure. The control system 300 includes a controller 302, a first input device 304, and a second input device 306. The first input device 304 and the second input device 306 may include the user interface display, dials, rollers, pedals, joy-sticks, switches, lever, push buttons, or the like. The first and the second input devices 304, 306 may be incorporated within the user interfaces 118 and 120 for accepting various inputs from the operator. In an embodiment, the first and the second input devices 304, 306 may be incorporated within a same device, such as a joy-stick, a user interface display, dials, lever etc.

The controller 302 is configured to receive operator control signals, based on the input from the operator, from the first input device 304 and the second input device 306. The controller 302 may be a microprocessor based system that output a command signal based on the received operator control signals. The command signal is received by an electrohydraulic control valve 308. The electrohydraulic control valve 308 may be a solenoid actuated valve and configured to control a flow of hydraulic fluid to the hydraulic cylinder 215 to extend and retract the extendable screed 106 relative to the main screed 104. Further, a position sensor 310 may be provided to measure a linear extension of the hydraulic cylinder 215 and send a position signal to the controller 302. The position sensor 310 may be one of several well known linear displacement transducers.

In an embodiment, the first input device 304 may be configured to set a speed limit for the extendable screed 106. Various sensors associated with the first input device 304 may produce an operator control signal, such as a limiting signal indicative of a speed limit of the extendable screed 106. In an embodiment, the speed limit of the extendable screed 106 may include discrete values, such as low speed, medium speed, and high speed. In another embodiment, the speed limit of the extendable screed 106 may be selected from various continuous values with a gradual increase from the low speed to a maximum speed. In an embodiment, the second input deice 306 may be configured to vary a speed of the extendable screed 106 within the speed limit. The second input device 306 may produce another operator control signal, such as a control signal to vary the speed of the extendable screed within the speed limit. In an embodiment, the control signal may be based on a relative position of the second input device 306 set by the operator. The relative position of the second input device 306 may include a rotational, linear, or angular position of the second input device 306, such as a dial, roller, pedal, joy-stick, lever etc., with respect to an initial position.

The controller 302 may include a system memory 312 and a processor 314. The system memory 312 may include for example, but not limited to, a Random Access Memory (RAM), a Read Only Memory (ROM), flash memory, a data structure, and the like. The system memory 312 may store a computer executable code to compute the speed of the extendable screed 106 based on the limiting signal, and the control signal received from the first input deice 304 and the second input device 306, respectively. The system memory 312 may be operable on the processor 314 to compute the speed of the extendable screed 106. In an embodiment, the processor 314 may be configured to compute the speed of the extendable screed 106 as a percentage of the speed limit in response to the relative position of the second input device 306. In an embodiment, the speed of the extendable screed 106 may be linearly proportional to the relative position of the second input device 306. For example, at 50% relative position of the second input device 306, the speed of the extendable screed 106 is substantially equal to 50% of the speed limit.

In another embodiment, the speed of the extendable screed 106 may be non-linearly proportional to the relative position of the second input device 306. In an embodiment, the control system 300 may further include a third input device 316 configured to govern a relationship between the speed of the extendable screed 106 and the relative position of the second input device 306. The third input device 316 device may include a dial, user interface display, switch, push button etc. Further, the third input device 316 may be also incorporated with the second input device 306. In an embodiment, a linear or a non-linear relationship may be achieved by modification of a modulation curve governing the relationship between the speed of the extendable screed 106 and the relative position of the second input device 306.

Moreover, it may be understood to a person skilled in art that the controller 302 may be integrated with various input and output devices associated with the other operations of the paver 100, such as travel, steering, braking etc. The controller 302 may also include a display unit to display various parameters associated with the paver 100, such as travel speed, slope, height, and extension of the screed assembly 102.

INDUSTRIAL APPLICABILITY

The control system 300 described above allows the operator to controllably vary the speed of the extendable screed 106 within the set speed limit. Moreover, the control system 300 may also allow selecting the modulation curve to further control the variation in the speed of the extendable screed 106 within the speed limit.

Figure 4:
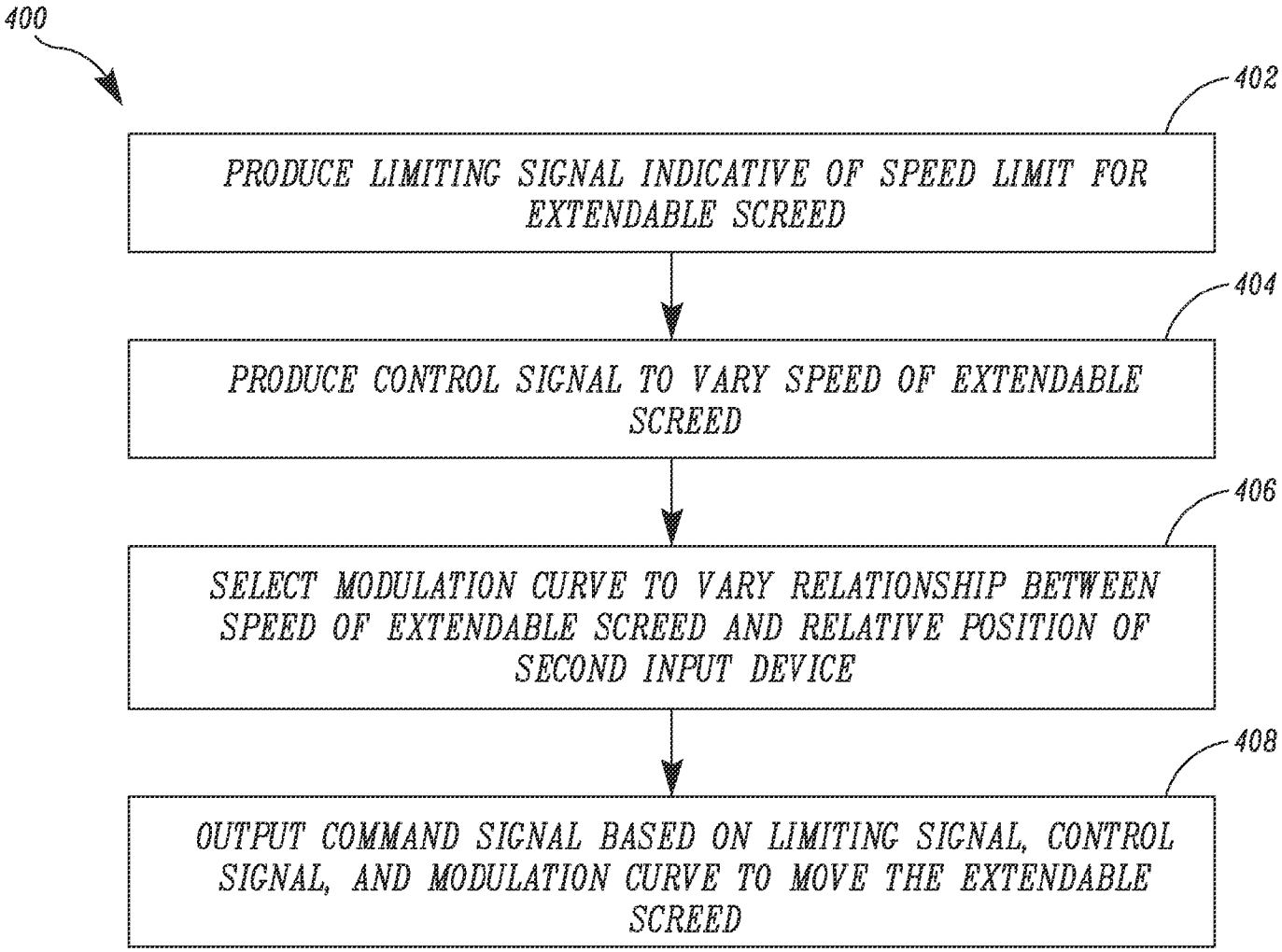
FIG. 4 illustrates a flow chart for a method of moving an extendable screed.

FIG. 4 illustrates a method 400 for moving the extendable screed 106. In step 402, the operator may set the speed limit, for example low speed, medium speed, or high speed using the first input device 304. The first input device 304 may produce the limiting signal and sends to the controller 302. In an embodiment, the limiting signal may limit an output of a pressurized hydraulic fluid source, such as a hydraulic pump. Accordingly, a pressure and a volume of the hydraulic fluid which enters the hydraulic cylinder 215 limit a maximum speed of the extendable screed 106.

In the following step 404, the operator may produce the control signal using the second input device 306 to vary the speed of the extendable screed 106 within the speed limit, the maximum speed. According to an aspect of the present disclosure, at step 406, the operator may select the modulation curve using the third input device 316 to vary the relationship between the speed of the extendable screed 106 and the relative position of the second input device 306. In the following step 408, the controller may receive the limiting signal, the control signal, and the modulation curve to output the command signal. In an embodiment, the command signal may control the electrohydraulic control valve 308 to vary the flow of pressurized hydraulic fluid to the hydraulic cylinder 215.

Figure 5:
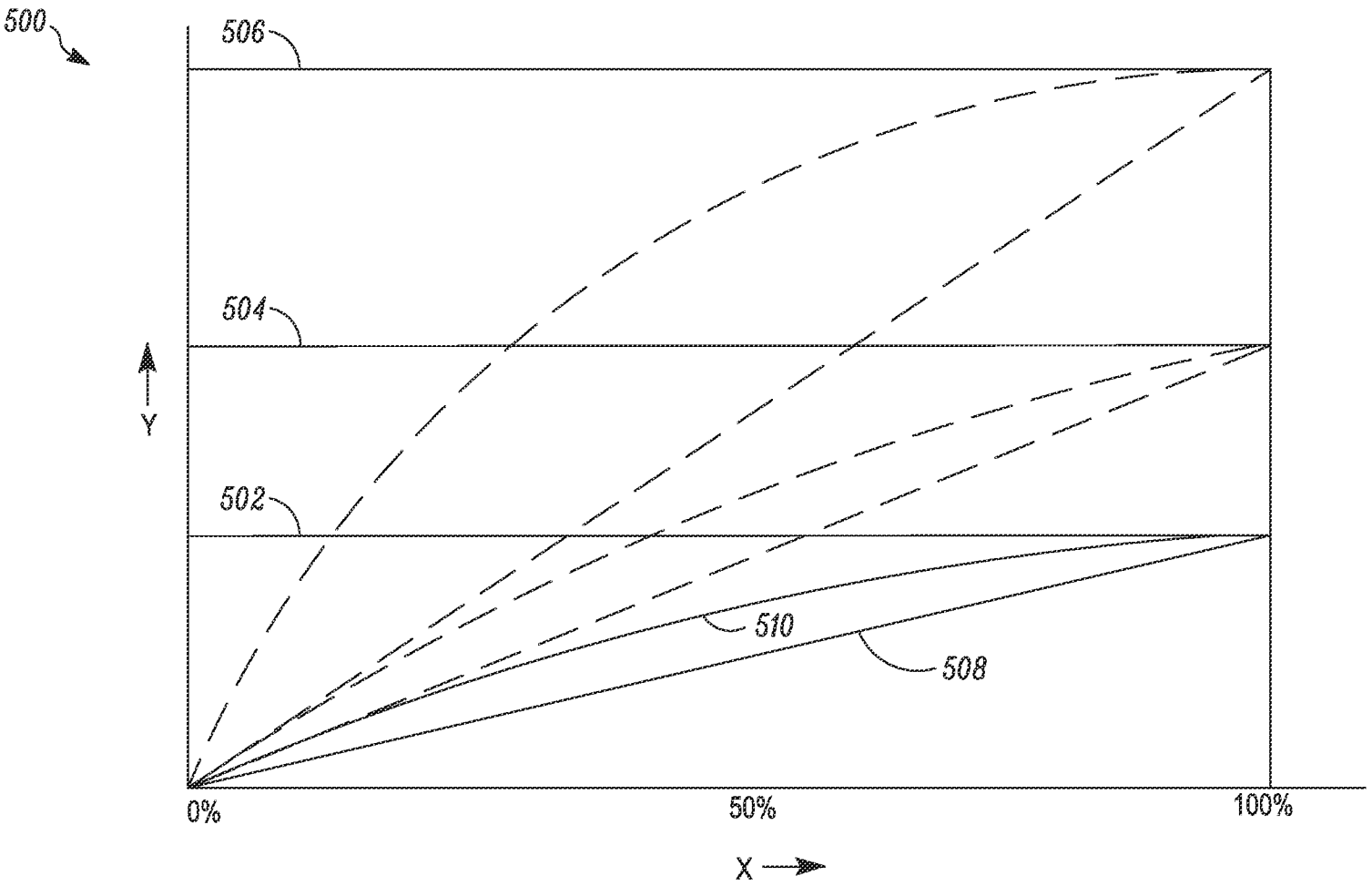
FIG. 5 illustrated an exemplary curve between a speed of the extendable screed and a relative position of a second input device.

FIG. 5 illustrated an exemplary curve 500 between the speed of the extendable screed 106 and the relative position of the second input device 306. Along X-axis, the relative position of the second input device 306 may vary from 0% to about 100%. Along Y-axis, the speed of the extendable screed 106 may increase from zero to a maximum speed. Further, based on the input received from the first input device 304 the speed limit for the extendable screed 106 may be set to two or more values, whereas in this case 502, 504, and 506 represent low speed, medium speed, and high speed respectively.

In an embodiment, the operator may select the low speed limit 502 using the first input device 304. Following the same, the operator may change the relative position of the second input device 306 to vary the speed of the extendable screed 106 within the low speed limit 502 along a substantially linear curve 508. Moreover, the operator may also select a modulation curve 510 using the third input device 316 to vary the speed of the extendable screed 106. The modulation curve 510, as illustrated, may be parabolic and positioned outwardly with respect to the linear curve 508. Thus, when the operator moves the second input device 306 to 50%, the speed of the extendable screed 106 may be greater than 50% of the low speed limit 502. In another embodiment, the modulation curve 510 may be positioned inwardly with respect to the linear curve 508. This gives the operator better speed control for the extendable screed 106 during operation.

Although the embodiments of this disclosure as described herein may be incorporated without departing from the scope of the following claims, it will be apparent to those skilled in the art that various modifications and variations can be made. Other embodiments will be apparent to those skilled in the art from consideration of the specification and practice of the disclosure. It is intended that the specification and examples be considered as exemplary only, with a true scope being indicated by the following claims and their equivalents.

What is claimed is:

1. A screed assembly comprising:

a main screed;

an extendable screed movably attached to the main screed; and a control system for the extendable screed comprising:

a first input device configured to set a speed limit for the extendable screed;

a second input device configured to vary a speed of the extendable screed within the speed limit;

a third input device configured to govern a relationship between a speed of the extendable screed and a relative position of the second input device; and a controller configured to receive inputs from the first, the second, and the third input devices and output a command signal to move the extendable screed relative to the main screed.

2. The screed assembly of claim 1, wherein the controller comprises a processor configured to compute the speed of the extendable screed as a percentage of the speed limit in response to the relative position of the second input device.

3. The screed assembly of claim 1, wherein the speed of the extendable screed is linearly proportional to the relative position of the second input device.

4. The screed assembly of claim 1, wherein the speed of the extendable screed is non-linearly proportional to the relative position of the second input device.

5. The screed assembly of claim 1, wherein the second input device comprises the third input device.

6. The screed assembly of claim 1, wherein the command signal is received by an electrohydraulic control valve.

7. The screed assembly of claim 6, wherein the electrohydraulic control valve is configured to control a flow of hydraulic fluid to a hydraulic cylinder associated with the extendable screed.

8. The screed assembly of claim 7 further comprising a position sensor associated with the hydraulic cylinder to measure a linear extension of the hydraulic cylinder.

9. The screed assembly of claim 8, wherein the position sensor is configured to send a position signal indicative of the linear extension of the hydraulic cylinder to the controller.

10. A method for moving an extendable screed relative to a main screed in a screed assembly, the method comprising:

producing a limiting signal indicative of a speed limit for the extendable screed from a first input device;

producing a control signal for varying a speed of the extendable screed within the speed limit from a second input device;

selecting a modulation curve using a third input device for varying a relationship between a speed of the extendable screed and a relative position of the second input device; and receiving the limiting signal and the control signal by a controller and outputting a command signal to move the extendable screed relative to the main screed.

11. The method of claim 10, wherein varying the speed of the extendable screed comprises computing the speed as a percentage of the speed limit in response to the relative position of the second input device.

12. The method of claim 10 further comprising computing the speed of the extendable screed in linear proportion to the relative position of the second input device.

13. The method of claim 10 further comprising computing the speed of the extendable screed in non-linear proportion to the relative position of the second input device.

14. The method of claim 10 further comprising receiving the command signal by an electrohydraulic control valve.

15. The method of claim 14 further comprising controlling a flow of hydraulic fluid to a hydraulic cylinder associated with the extendable screed by the electrohydraulic control valve.

16. A control system for an extendable screed movable relative to a main screed in a screed assembly comprising:

a first input device configured to set a speed limit of the extendable screed;

a second input device configured to vary a speed of the extendable screed within the speed limit;

a third input device configured to govern a relationship between a speed of the extendable screed and a relative position of the second input device; and a controller configured to receive inputs from the first and the second input devices and output a command signal to move the extendable screed relative to the main screed.

17. The control system of claim 16, wherein the controller comprises a processor configured to compute the speed of the extendable screed as a percentage of the speed limit in response to the relative position of the second input device.

18. The control system of claim 16, wherein the speed of the extendable screed is linearly proportional to the relative position of the second input device.

19. The control system of claim 16, wherein the speed of the extendable screed is non-linearly proportional to the relative position of the second input device.

20. The control system of claim 16, wherein the second input device comprises the third input device.

* * * * *